US007100898B1

(12) United States Patent
Chang

(10) Patent No.: US 7,100,898 B1
(45) Date of Patent: Sep. 5, 2006

(54) LIFTING JACK

(75) Inventor: Wen-Cheng Chang, Pai-Chiao (TW)

(73) Assignee: John Chen, Northridge, CA (US)

( * ) Notice: Subject to any disclaimer, the term of this patent is extended or adjusted under 35 U.S.C. 154(b) by 0 days.

(21) Appl. No.: 11/247,461

(22) Filed: Oct. 11, 2005

(30) Foreign Application Priority Data

Apr. 27, 2005 (TW) ..... 94206627 U

(51) Int. Cl.
*B66F 3/24* (2006.01)

(52) U.S. Cl. ..... 254/126

(58) Field of Classification Search ..... 254/1, 254/2 B, 6 B, 7 B, 8 B, 10 B, 120, 124, 254/126, DIG. 1, DIG. 2; 269/11; 89/57.29; 359/838

See application file for complete search history.

(56) References Cited

U.S. PATENT DOCUMENTS 5,707,043 A * 1/1998 Yoshida ..... 254/126

* cited by examiner

*Primary Examiner*—Robert C. Watson
(74) *Attorney, Agent, or Firm*—Michael A. Bondi

(57) ABSTRACT

A lifting jack includes a lifting mechanism pivoted to a base and a support bracket member so as to lift or lower the support bracket member relative to the base, a driving shaft journalled on a right link pin to be rotated so as to move a left link pin relative to the right link pin, a reflecting member hinged to the base so as to enable the reflecting member to be displaced from a folded position to an unfolded position and to be disposed to reflect images of an object lifted by the support bracket member. Preferably, a lighting device is disposed to illuminate a desired area of the object. Two limit switches are disposed to prevent excess movement of the bracket support member.

11 Claims, 7 Drawing Sheets

LIFTING JACK

CROSS-REFERENCE TO RELATED APPLICATION

This application claims priority of Taiwanese Application No. 094206627, filed on Apr. 27, 2005.

BACKGROUND OF THE INVENTION

1. Field of the Invention

This invention relates to a lifting jack, more particularly to a lifting jack which has a reflection member hinged to a base to reflect images of an object lifted by the lifting jack.

2. Description of the Related Art

Referring to FIG. 1, a conventional scissor jack 1 is shown to include a base 11, a lifting mechanism 12 and a driving device 13. The lifting mechanism 12 includes two lower arm members 121 with proximate ends pivoted to the base 11, and two upper arm members 122 having proximate ends pivoted to distal ends of the lower arm members 121, and distal ends pivoted to a support bracket member 123 that is adapted to support a raised object, such as an automobile. The driving device 13 includes a motor 131 which is secured to a mount plate 124 disposed on the upper arm member 122, a driving shaft 132 which extends through one of the upper arm members 122 and one of the lower arm members 121 and which has a threaded segment 133 threadedly engaging the other one of the upper arm members 122 and the other one of the lower arm members 121 such that the driving shaft 132 is actuated by the motor 131 to rotate so as to move the upper and lower arm members 122, 121 towards or away from each other, thereby lifting or lowering the support bracket member 123.

When the conventional scissor jack 1 is used to lift a car for maintenance work, the operator must lie on the ground in order to be able to inspect the chassis of the car, which is inconvenient to the operator. Moreover, since the space under the lifted chassis is dark, the operator has to carry a lighting device, such as a flashlight, to illuminate the chassis, which is also inconvenient to the operator. Furthermore, excess movement of the support bracket member 123 may occur to result in danger to the operator.

SUMMARY OF THE INVENTION

A main object of the present invention is to provide a lifting jack which has a reflecting member for reflecting images of a lifted object so as to facilitate maintenance of the object.

Another object of the present invention is to provide a lifting jack which has lighting and safety devices to illuminate a lifted object and to prevent excess movement of the object.

According to this invention, the lifting jack includes a base which includes a bottom wall that is elongated in a longitudinal direction, and a mount wall unit that extends from front and rear sides of the base in an upright direction and that has first and second pivoted areas opposite to each other in the longitudinal direction. A support bracket member is spaced apart from the bottom wall in the upright direction, and is movable towards and away from the bottom wall. A first arm member has first proximate end pivoted to the first pivoted area, and a first distal end opposite to the first proximate end. A second arm member has a second proximate end pivoted to the second pivoted area, and a second distal end opposite to the second proximate end. A third arm member has a third proximate end pivotally mounted on the support bracket member, and a third distal end opposite to the third proximate end. A fourth arm member has a fourth proximate end pivotally mounted on the support bracket member, and a fourth distal end opposite to the fourth proximate end. Left and right link pins define left and right pivot axes, respectively, and are disposed to couple the first and second distal ends to the third and fourth distal ends, respectively, such that the first and third distal ends are jointly pivoted about the right pivot axis, and such that the second and fourth distal ends are jointly pivoted about the left pivot axis. A driving shaft extends along a lengthwise axis in the longitudinal direction, and has a journal segment which is journalled on the right link pin so as to be rotatable about the lengthwise axis, and which extends to terminate at an input end, and a threaded segment which is opposite to the journal segment in the longitudinal direction, and which is threadedly engaged with the left link pin such that when the threaded segment is driven to rotate relative to the right link pin about the lengthwise axis so as to move the left link pin towards or away from the right link pin, the support bracket member is moved away from or towards the bottom wall, thereby placing the support bracket member in an uppermost or lowermost position. A reflecting member has a lower side hinged to one of the front and rear sides of the bottom wall about a hinging axis in the longitudinal direction so as to enable the reflecting member to be displaced from a folded position, where an upper side of the reflecting member is closer to the mount wall unit, to an unfolded position, where the upper side of the reflecting member is remote from the mount wall unit, and is disposed to reflect images of an object lifted by the support bracket member.

Preferably, first and second limit switches are respectively and electrically connected to an electric motor such that when the support bracket member is displaced to an uppermost position or a lowermost position, the first distal end of the first arm member correspondingly actuates the first limit switch or the second limit switch to switch off the electric motor, thereby preventing excess movement of the support bracket member for safety purposes.

Preferably, a lighting device is rotatably disposed on a mounting frame pivoted to the right link pin to illuminate a desired area of the lifted object.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
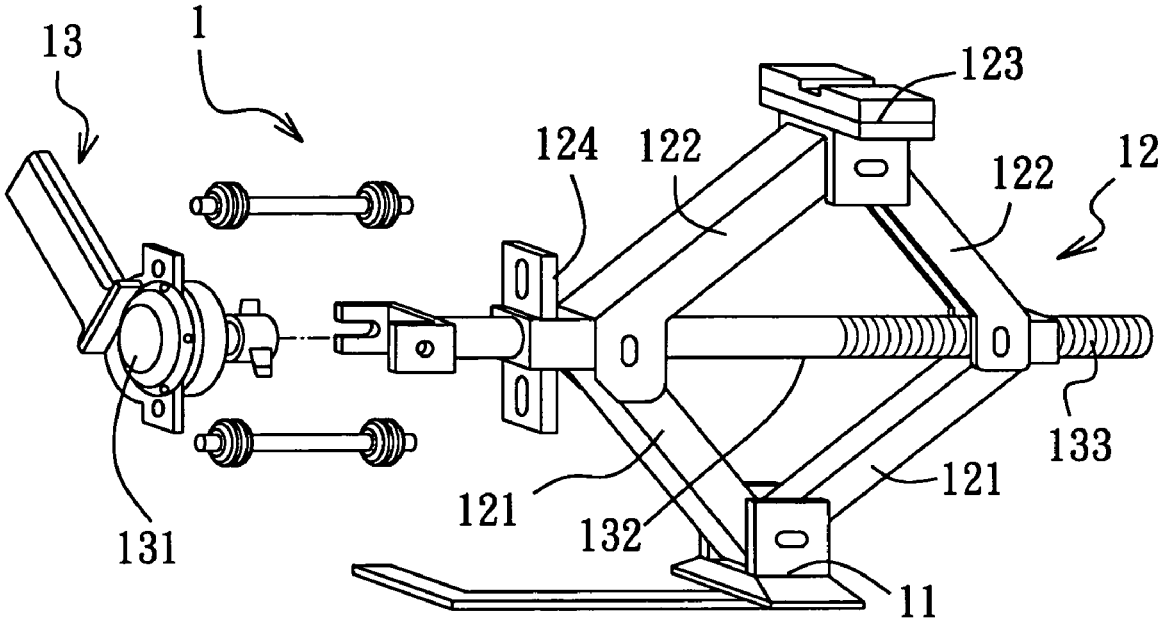
F I G. 1 PRIOR ART
FIG. 1 is an exploded perspective view of a conventional scissor jack.
Figure 2:
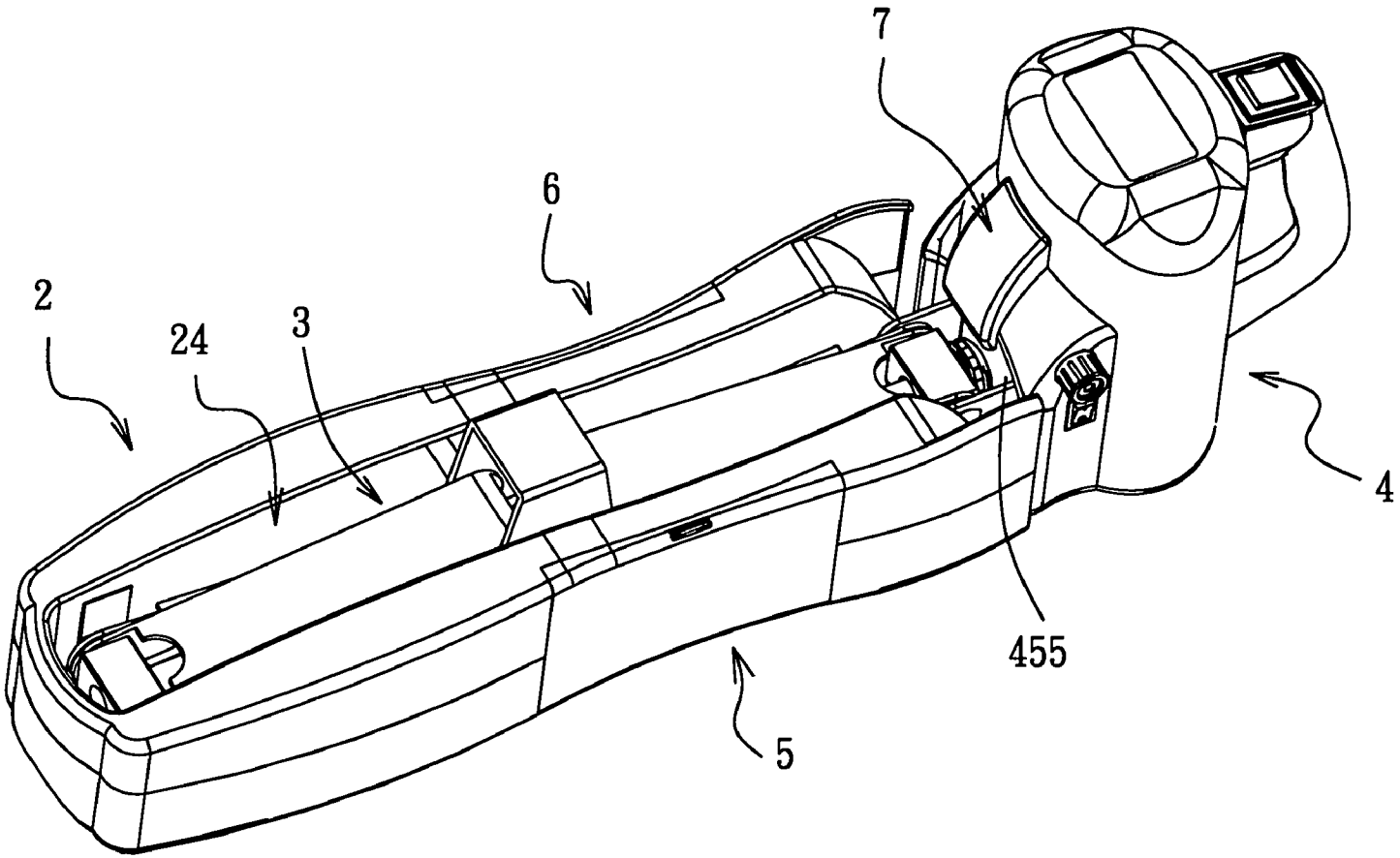
FIG. 2 is a perspective view of the preferred embodiment of a lifting jack according to this invention.
Figure 3:
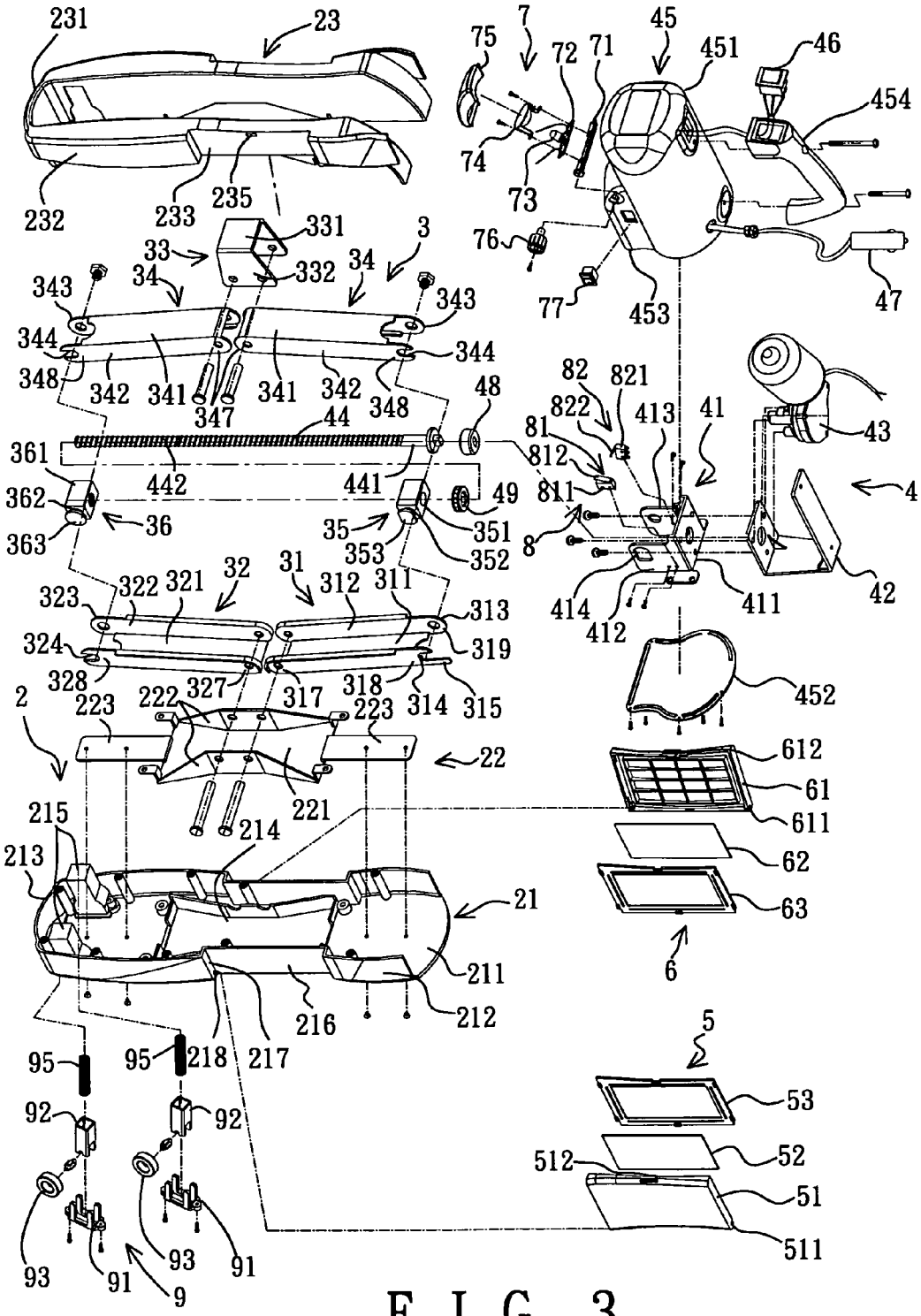
FIG. 3 is an exploded perspective view of the preferred embodiment.

Referring to FIGS. 2 and 3, the preferred embodiment of a lifting jack according to the present invention is shown to comprise a base 2, a lifting mechanism 3, a driving device 4, first and second reflecting members 5, 6, a lighting device 7, a safety device 8, and a rolling assembly 9.

The base 2 includes plastic upper and lower shell halves 21, 23 which are coupled with each other, and a metal base seat 22. The lower shell half 21 has a bottom wall 211 which is elongated in a longitudinal direction and which has front and rear sides opposite to each other in a transverse direction relative to the longitudinal direction, two side walls 212 which extend respectively from the front and rear sides of the bottom wall 211 in an upright direction, and a connecting wall 213 which interconnects the side walls 212. The bottom wall 211 has a generally rectangular slot 214 therein, and two receptacles 215 formed therein adjacent to the connecting wall 213. A recessed portion 216 is disposed in each of the side walls 212 such that two shoulders 217 are respectively defined at junctures between the recessed portion 216 and the sidewall 212. Two pivot pins 218 are disposed respectively on the shoulders 217 adjacent to the bottom wall 211. The base seat 22 has a base wall 221 disposed in the rectangular slot 214 and aligned with the bottom wall 211, a mount wall unit including two mount walls 222 which extend respectively from front and rear sides of the base wall 221 in the upright direction, and which respectively have first and second pivoted areas opposite to each other in the longitudinal direction, and two locking plates 223 which extend respectively from left and right sides of the base wall 221 to be secured onto the bottom wall 211. The upper shell half 23 is U-shaped, and is coupled with the lower shell half 21 to cooperatively define an accommodation space 24 with an upper opening. The upper shell half 23 includes two side walls 232 and a connecting wall 231. Each of the side walls 232 has a recessed portion 233 which is formed with an engaging aperture 235.

The lifting mechanism 3 is received in the accommodation space 24, and includes a support bracket member 33, first and second arm members 31, 32, third and fourth arm members 34, and left and right link pins 36, 35.

The support bracket member 33 is spaced apart from the bottom wall 211 in the upright direction, and includes a top support plate 331 for supporting an object (not shown), and two side plates 332. The first and second arm members 31, 32 have the same construction, and each include a connecting plate portion 311, 321, and two side plate portions 312, 322 which extend from front and rear sides of the connecting plate portions 311, 321, respectively. The side plate portions 312 of the first arm member 31 have a first proximate end 317 which is pivoted to the first pivoted area of the mount walls 222 of the base seat 22, and a first distal end 318 opposite to the first proximate end 317. The side plate portions 322 of the second arm member 32 have a second proximate end 327 which is pivoted to the second pivoted area of the mount walls 222 of the base seat 22, and a second distal end 328 opposite to the second proximate end 327. The first arm member 31 has first and second contact tongues 315, 319 which extend from the first distal end 318 away from the first proximate end 317. Each of the third and fourth arm members 34 includes a connecting plate portion 341, and two side plate portions 342 which extend from front and rear sides of the connecting plate portion 341, respectively. The side plate portions 342 of the third arm member 34 have a third proximate end 347 which is pivoted to the side plates 332 of the support bracket member 33, and a third distal ends 348 opposite to the third proximate end 347. The side plate portions 342 of the fourth arm member 34 have a fourth proximate end 347 which is pivoted to the side plates 332 of the support bracket member 33, and a fourth distal end 348 opposite to the fourth proximate end 347. The left and right link pins 36, 35 define left and right pivot axes, respectively, and are disposed to couple the first and second distal ends 318, 328 to the third and fourth distal ends 348, respectively, such that the first and third distal ends 318, 348 are jointly pivoted about the right pivot axis, and such that the second and fourth distal ends 328, 348 are jointly pivoted about the left pivot axis. Each of the left and right link pins 36, 35 includes a base portion 361, 351, a retaining portion 363,353, and a journal portion 362, 352 between the base portion 361, 351 and the retaining portion 363, 353. A snap-fit area 344 of one of the side plate portions 342 of the third arm member 34 and a snap-fit area 314 of one of the side plate portions 312 of the first arm member 31 are aligned with each other in the transverse direction, and are journalled on the journal portion 352. A lug 343 of the other one of the side plate portions 342 of the third arm member 34, and a lug 313 of the other one of the side plate portion 312 of the first arm member 31 are pivoted on a rear side of the base portion 351 by means of a screw. Similarly, snap-fit areas 344, 324 of the side plate portions 342, 322 of the fourth and second arm members 34, 32 are aligned with each other in the transverse direction, and are journalled on the journal portion 362, whereas lugs 343, 323 of the side plate portions 342, 322 of the fourth and second arm members 34, 32 are pivoted on a rear side of the base portion 361 by means of a screw. Thus, the support bracket member 33 is movable away or and towards the bottom wall 211 by stretching or collapsing the third and fourth arm members 34 relative to the first and second arm members 31, 32.

Figure 5:
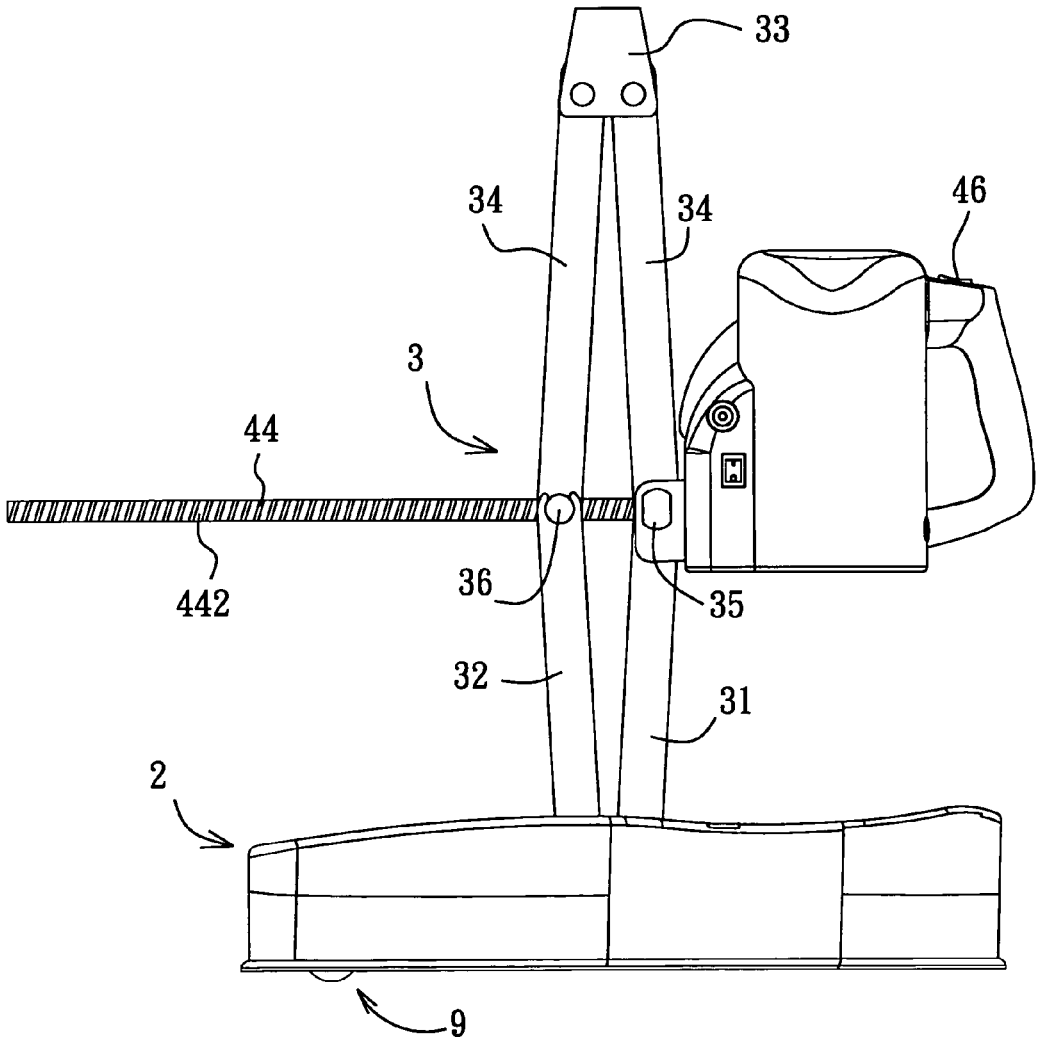
FIG. 5 is a schematic side view of the preferred embodiment in a working state.

The driving device 4 includes a mounting frame, a driving shaft 44, an electric motor 43, and a switch member 46. The mounting frame is disposed rightwardly of the first arm member 31, and includes a U-shaped rack 41, a motor positioning rack 42, and a housing 45. The U-shaped rack 41 includes a right plate 411, and front and rear plates 412, 413 extending from front and rear sides of the right plate 411 in the longitudinal direction. The front plate 412 has a through hole 414 for engaging the retaining portion 353 of the right link pin 35 so as to be pivotally connected to the right link pin 35 about the right pivot axis. The motor positioning rack 42 is secured on a right surface of the right plate 411 for positioning the electric motor 43. The driving shaft 44 extends along a lengthwise axis in the longitudinal direction, and has a journal segment 441 which terminates at an input end that is coupled with an output shaft of the electric motor 43 through a washer 48 and which is journalled on the right link pin 35 by an anti-friction bearing 49 so as to be driven to rotate about the lengthwise axis, and a threaded segment 442 which is opposite to the journal segment 441 in the longitudinal direction and which is threadedly engaged with the left link pin 36. Thus, as shown in FIG. 5, when the threaded segment 442 is driven to rotate about the lengthwise axis so as to move the left link pin 36 towards or away from the right link pin 35, the support bracket member 33 is moved away from or towards the bottom wall 211, thereby placing the support bracket member 33 in an uppermost or lowermost position. In this embodiment, the electric motor 43 is a 12-volt D.C. motor. The housing 45 includes a housing body 451, a cover 452 which is locked onto a bottom end of the housing body 451 to cooperatively define a receiving space for receiving the U-shaped rack 41, a motor positioning rack 42, and an electric motor 43, and a handgrip 454. The housing body 451 has an extension portion 453 with an opening 455 for projection of parts of the front and rear plates 412, 413 therethrough. The switch member 46 is disposed on the handgrip 454 to control the electric motor 43 to rotate the driving shaft 44 in a clockwise or counterclockwise direction so as to adjustably move the support bracket member 33 to a working position between the uppermost and lowermost positions. A vehicular connector 47 is electrically connected to the electric motor 43, and is adapted for coupling with a power source, such as a 12-volt car cigarette lighter (not shown).

Figure 4:
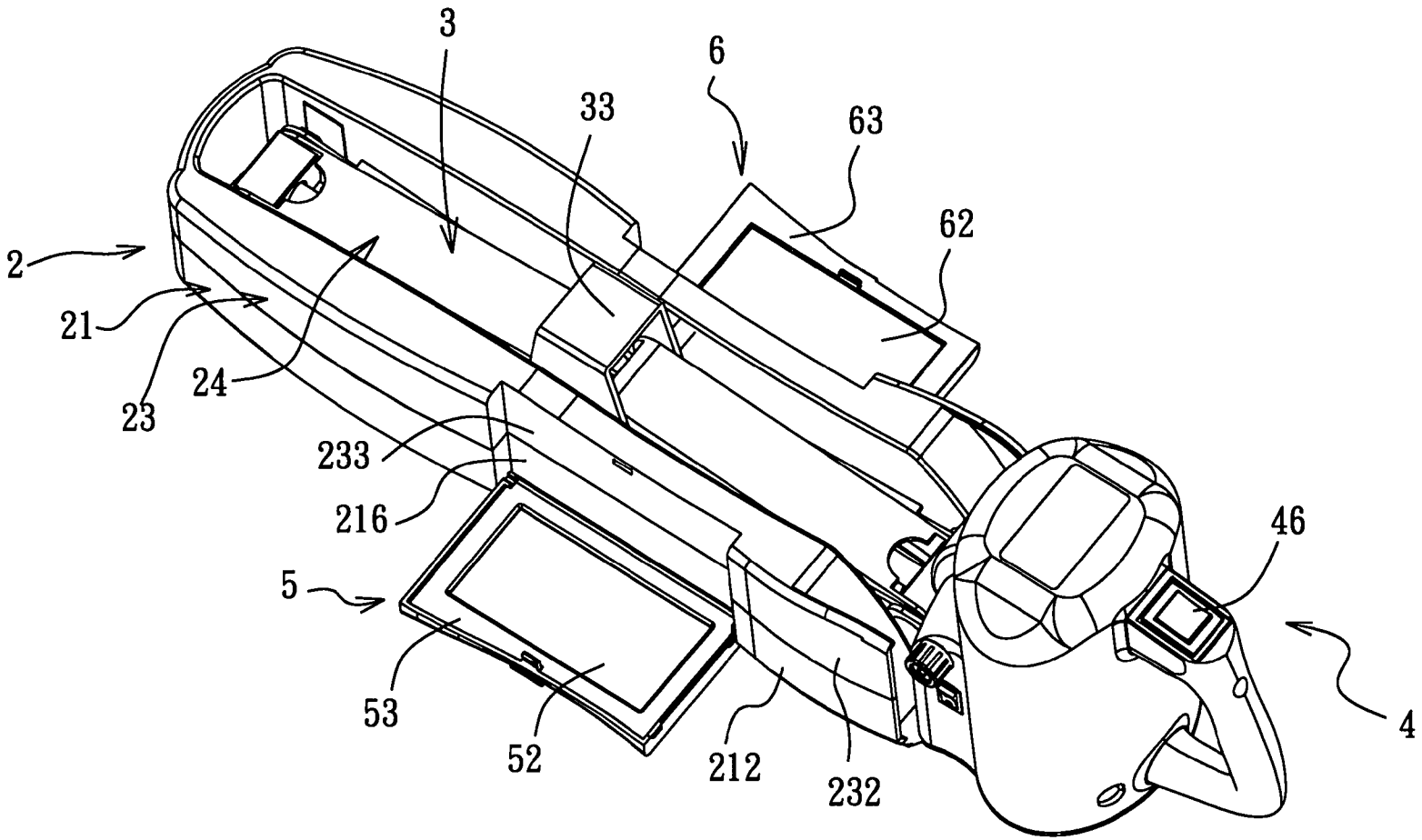
FIG. 4 is a perspective view of the preferred embodiment showing first and second reflecting members in an unfolded position.

Each of the first and second reflecting members 5, 6 includes a frame body having outer and inner frame portions 51,53,61,63, and a mirror piece 52, 62 interposed between the outer and inner frame portions 51,53,61,63. The outer frame portion 51, 61 serves as a lower side of the respective reflecting member 5, 6, and is formed with two hinged holes 511, 611 to engage the respective pivot pins 218 so as to be hinged about a respective one of first and second hinging axes in the longitudinal direction. The outer frame portion 51, 61 further has a retaining protrusion 512, 612 to engage the respective engaging aperture 235. The mirror piece 52 serves as the upper side of the respective reflecting member 5, 6. Thus, each of the first and second reflecting members 5, 6 is displaceable from a folded position, as shown in FIG. 2, where the mirror piece 52, 62 is closer to the respective recessed portion 216 so that the mirror piece 52, 62 is hidden between the frame body and the side wall 212 of the lower shell half 21, to an unfolded position, as shown in FIG. 4, where the mirror piece 52, 62 is remote from the respective recessed portion 216 and is exposed to confront upwardly so as to be disposed to reflect images of an object (not shown), such as a car chassis lifted by the support bracket member 33. Therefore, maintenance operation of the chassis is convenient to conduct. Furthermore, the first and second reflecting members 5, 6 are foldable to facilitate storage of the lifting jack.

Figure 8:
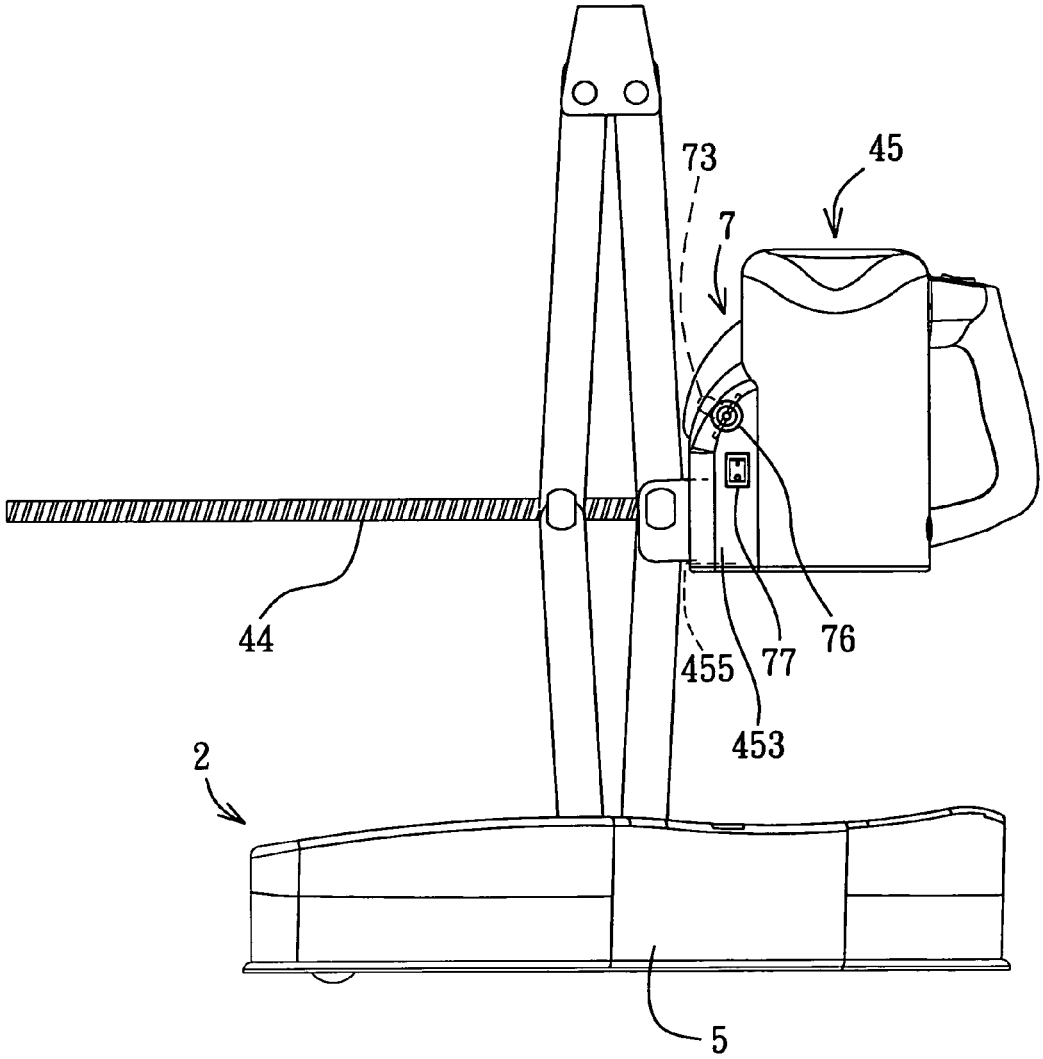
FIG. 8 is a schematic side view showing how to adjust a lighting device of the preferred embodiment of this invention.

With reference to FIGS. 3 and 8, the lighting device 7 includes a pivot axle 71 which is pivotally mounted on the extension portion 453 of the housing body 451 above the opening 455 and which is rotatable relative to the extension portion 453 about a rotating axis that is parallel to the left pivot axis, a lighting element 73, 74 which is electrically connected to a circuit board 72 that is secured on the pivot axle 71, a transparent cap 75 which covers the lighting element 73, 74, a switch 77 which is disposed on a front side of the extension portion 453 and which is electrically connected to the circuit board 72 to form a circuit assembly that can control supply of electric power to the lighting element 73, 74, and a rotary knob 76 which is operable to rotate the pivot axle 71 about the rotating axis. In this embodiment, the lighting element 73, 74 includes a light-emitting diode. Thus, operation of the rotary knob 76 results in rotation of the pivot axle 71 about the rotating axis so that an irradiating angle of the light emitting from the lighting element 73, 74 can be adjusted relative to the housing 45 so as to irradiate a desired area of the lifted object.

Figure 6:
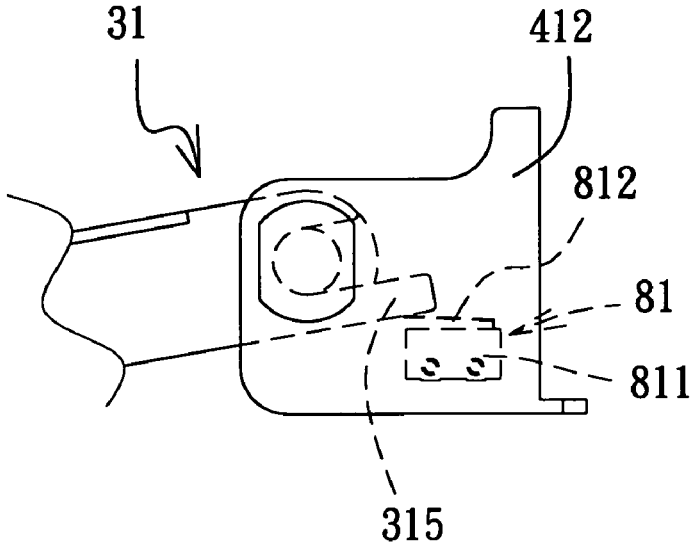
FIG. 6 is a schematic view showing the state in which a tongue of an arm member is in contact with a first limit switch according to the preferred embodiment of this invention.
Figure 7:
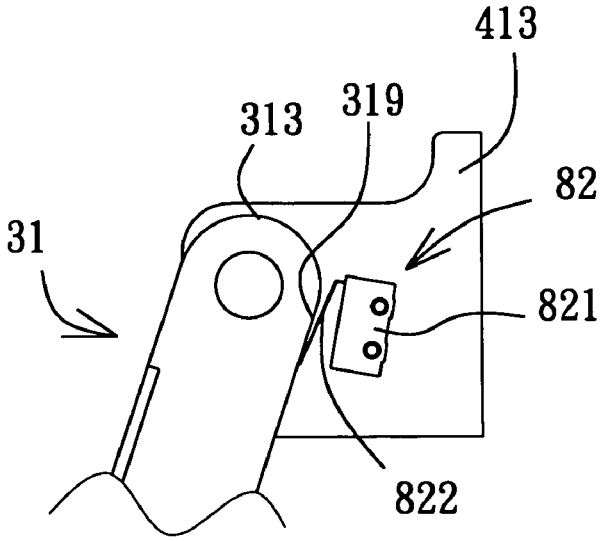
FIG. 7 is a schematic view showing the state in which another tongue of the arm member is in contact with a second limit switch according to this preferred embodiment of this invention.

The safety device 8 includes first and second limit switches 81, 82 which are electrically connected to the electric motor 43, and which are mounted on inner surfaces of the front and rear plates 412, 413, respectively. With reference to FIGS. 3, 6 and 7, the first and second limit switches 81, 82 respectively have first and second switch bodies 811, 821, and first and second terminals 812, 822 which extend from the first and second switch bodies 811, 821 and which are configured such that when the support bracket member 33 reaches the lowermost position, the first contact tongue 315 is in contact with the first terminal 812 to switch off the electric motor 43, and such that when the support bracket member 33 reaches the uppermost position, the second contact tongue 319 is in contact with the second terminal 822 to switch off the electric motor 43. Thus, any excess movement of the support bracket member 33 can be prevented for ensuring safer operation of the lifting jack.

The rolling assembly 9 includes two support seats 91 secured on the bottom wall 211 under the receptacles 215, respectively, and two mounting shells 92 supported by the support seats 91 to be received in the receptacles 215, respectively, for receiving two springs 95 and two rolling members 93 therein. By means of the springs 95, the rolling members 93 can partially extend downwardly of the bottom wall 211 to permit rolling movement of the lifting jack. When the springs 93 are deformed by an object supported by the support bracket member 33, the rolling members 93 are fully retracted into the receptacles 215 to prevent rolling movement of the lifting jack during operation.

As illustrated, by means of the arrangement of the first and second reflecting members 5, 6 which have the mirror pieces 52, 62 to reflect the images of the bottom of the lifted object, specifically the chassis of a car, the operator can conveniently inspect the chassis for maintenance and repair. Besides, by providing the lighting device 7 which has the lighting element 73, 74 adjustable to a desired angle, the images of the bottom of the lifted object can be clearly seen. Moreover, due to the arrangement of the first and second limit switches 81, 82, stretching and collapsing of the third and fourth arm members 34 relative to the first and second arm members 31, 32 can be safer.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A lifting jack comprising:

a base which includes a bottom wall that is elongated in a longitudinal direction, and that has front and rear sides opposite to each other in a transverse direction relative to the longitudinal direction, and a mount wall unit that extends from both said front and rear sides in an upright direction and that has first and second pivoted areas opposite to each other in the longitudinal direction;

a support bracket member which is spaced apart from said bottom wall in the upright direction, and which is movable towards and away from said bottom wall;

a lifting mechanism pivoted to said first and second pivot areas and said support bracket member;

a driving device which is mounted on said lifting mechanism and which is driven to move said lifting mechanism so as to move said support bracket member away from or towards said bottom wall, thereby placing said support bracket member in an uppermost or lowermost position; and a first reflecting member which has lower and upper sides opposite to each other, said lower side being hinged to one of said front and rear sides of said bottom wall about a first hinging axis in the longitudinal direction so as to enable said first reflecting member to be displaced from a folded position, where said upper side is closer to said mount wall unit, to an unfolded position, where said upper side is remote from said mount wall unit and is disposed to reflect images of an object lifted by said support bracket member.

2. The lifting jack of claim 1, wherein said lifting mechanism includes a first arm member which has a first proximate end pivoted to said first pivoted area, and a first distal end opposite to said first proximate end, a second arm member which has a second proximate end pivoted to said second pivoted area, and a second distal end opposite to said second proximate end, a third arm member which has a third proximate end pivotally mounted on said support bracket member, and a third distal end opposite to said third proximate end, a fourth arm member which has a fourth proximate end pivotally mounted on said support bracket member, and a fourth distal end opposite to said fourth proximate end, and left and right link pins which define left and right pivot axes, respectively, and which are disposed to couple said first and second distal ends to said third and fourth distal ends, respectively, such that said first and third distal ends are jointly pivoted about said right pivot axis, and such that said second and fourth distal ends are jointly pivoted about said left pivot axis;

said driving device including a driving shaft extending along a lengthwise axis in the longitudinal direction, and having a journal segment which is journalled on said right link pin so as to be rotatable about the lengthwise axis, and which extends to terminate at an input end, and a threaded segment which is opposite to said journal segment in the longitudinal direction, and which is threadedly engaged with said left link pin such that when said threaded segment is driven to rotate relative to said right link pin about the lengthwise axis so as to move said left link pin towards or away from said right link pin, said support bracket member is moved away from or towards said bottom wall, thereby placing said support bracket member in an uppermost or lowermost position.

3. The lifting jack of claim 2, wherein said first reflecting member includes a frame body which serves as said lower side, and a mirror piece which serves as said upper side, said mirror piece being hidden between said frame body and said one of said front and rear sides in the folded position, and being exposed to confront upwardly in the unfolded position.

4. The lifting jack of claim 2, further comprising:

a mounting frame pivotally connected to said right link pin about the right pivot axis, and disposed rightwardly of said first arm member; and an electric motor mounted on said mounting frame, and having an output shaft which is coupled with said input end to deliver a drive to rotate said driving shaft relative to said right link pin.

5. The lifting jack of claim 4, further comprising a switch member which is disposed to control said electric motor to rotate said driving shaft in a clockwise or counterclockwise direction so as to adjustably move said support bracket member to a working position between the uppermost and lowermost positions.

6. The lifting jack of claim 4, further comprising:

first and second limit switches which are electrically connected to said electric motor, respectively, and which are mounted on said mounting frame and opposite to each other in the transverse direction such that when said support bracket member is displaced to the uppermost position or the lowermost position, said first distal end of said first arm member correspondingly actuates said first limit switch or said second limit switch to switch off said electric motor.

7. The lifting jack of claim 6, wherein said first arm member has first and second contact tongues which extend from said first distal end away from said first proximate end and which are disposed opposite to each other in the transverse direction, said first and second limit switches respectively having first and second terminals which are configured such that one of said first and second contact tongues is in contact with a corresponding one of said first and second terminals when said support bracket member reaches a corresponding one of the lowermost and uppermost positions.

8. The lifting jack of claim 4, further comprising a lighting device which includes a pivot axle which is pivotally mounted on said mounting frame and which is rotatable relative to said mounting frame about a rotating axis that is parallel to the left pivot axis;

a lighting element which is secured to said pivot axle; and a circuit assembly which is electrically connected to said lighting element so as to control supply of power to said lighting element.

9. The lifting jack of claim 8, wherein said lighting device further includes a rotary knob which is operable to rotate said pivot axle about the rotating axis.

10. The lifting jack of claim 1, wherein said base has a receptacle disposed in said bottom wall, said lifting jack further comprising a rolling member which is rotatably mounted on said bottom wall and which is retractable into said receptacle.

11. The lifting jack of claim 1, further comprising a second reflecting member which has lower and upper sides opposite to each other, said lower side of said reflecting member being hinged to the other one of said front and rear sides of said bottom wall about a second hinging axis in the longitudinal direction so as to enable said second reflecting member to be displaced from a folded position to an unfolded position so as to be disposed to reflect images of the object lifted by said support bracket member.

* * * * *